US006980113B1

(12) United States Patent
Uehran

(10) Patent No.: US 6,980,113 B1
(45) Date of Patent: Dec. 27, 2005

(54) WIRELESS SCOREBOARD DISPLAY SYSTEM

(75) Inventor: Randy S. Uehran, Brookings, SD (US)

(73) Assignee: Daktronics, Inc., Brookings, SD (US)

( * ) Notice: Subject to any disclaimer, the term of this patent is extended or adjusted under 35 U.S.C. 154(b) by 147 days.

(21) Appl. No.: 10/384,431

(22) Filed: Mar. 7, 2003

(51) Int. Cl.[7] ..... G08B 23/00
(52) U.S. Cl. ..... 340/573.1; 340/323 R; 340/825.69; 377/5; 463/4
(58) Field of Search ..... 340/323 R, 573.1, 340/825.69; 377/5; 463/4

(56) References Cited

U.S. PATENT DOCUMENTS 3,981,002 A * 9/1976 Gardner ..... 345/2.1
5,027,102 A * 6/1991 Sweeny ..... 340/323 R
5,341,121 A * 8/1994 Rada ..... 340/323 R
6,204,813 B1 * 3/2001 Wadell et al. ..... 342/463
6,270,431 B1 * 8/2001 Martin ..... 473/459
6,655,056 B1 * 12/2003 Wolf et al. ..... 40/124
6,700,051 B2 * 3/2004 Aldridge ..... 84/733
6,760,595 B2 * 7/2004 Inselberg ..... 455/517

* cited by examiner

*Primary Examiner*—Jeffery Hofsass
*Assistant Examiner*—Daniel Previl
(74) *Attorney, Agent, or Firm*—Hugh D. Jaeger, Esq.

(57) ABSTRACT

A wireless scoreboard display system, including at least two scoreboard displays, two controllers, a spread spectrum radio receiver in each scoreboard display, and a spread spectrum radio transmitter in each controller. Software controls the selection of a transmitting channel while a combination of hardware and software is used in the selection of a receiving channel.

19 Claims, 2 Drawing Sheets

WIRELESS SCOREBOARD DISPLAY SYSTEM

CROSS REFERENCES TO RELATED APPLICATIONS

None.

BACKGROUND OF THE INVENTION

1. Field of the Invention

The present invention is for a scoreboard system, and more particularly, pertains to a wireless scoreboard display system with at least two scoreboard displays, two controllers, a radio transmitter in each controller, and a radio receiver in each scoreboard display for controlling the scoreboard displays, either together or separately from one or both controllers.

2. Description of the Prior Art

In the past, it was difficult to control two scoreboard displays from one controller or two controllers, and it was always necessary to rewire the controllers. This was especially the case in indoor basketball games where scoreboard displays were operated for the entire court using one controller or for split courts using two controllers. The present invention overcomes the disadvantages of the prior art by providing a two-display two-controller system with RS spread spectrum radios where a transmitter is in each controller and a receiver is in each display.

SUMMARY OF THE INVENTION

The general purpose of the present invention is to provide a wireless scoreboard display system using spread spectrum radios for the scoreboard displays and controllers for an entire court, such as indoor basketball, for either entire court games or split court games.

According to the present invention, there is provided a wireless scoreboard display system, including at least two scoreboard displays, two controllers, a spread spectrum radio receiver in each scoreboard display, and a spread spectrum radio transmitter in each controller. Software controls the selection of a transmitting channel while a combination of hardware and software is used in the selection of a receiving channel.

One significant aspect and feature of the present invention is a wireless scoreboard display system incorporating spread spectrum radios to communicate data from controllers having spread spectrum radio transmitters to scoreboard displays having spread spectrum radio receivers for viewing the data on the scoreboard displays.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENT

Figure 1:
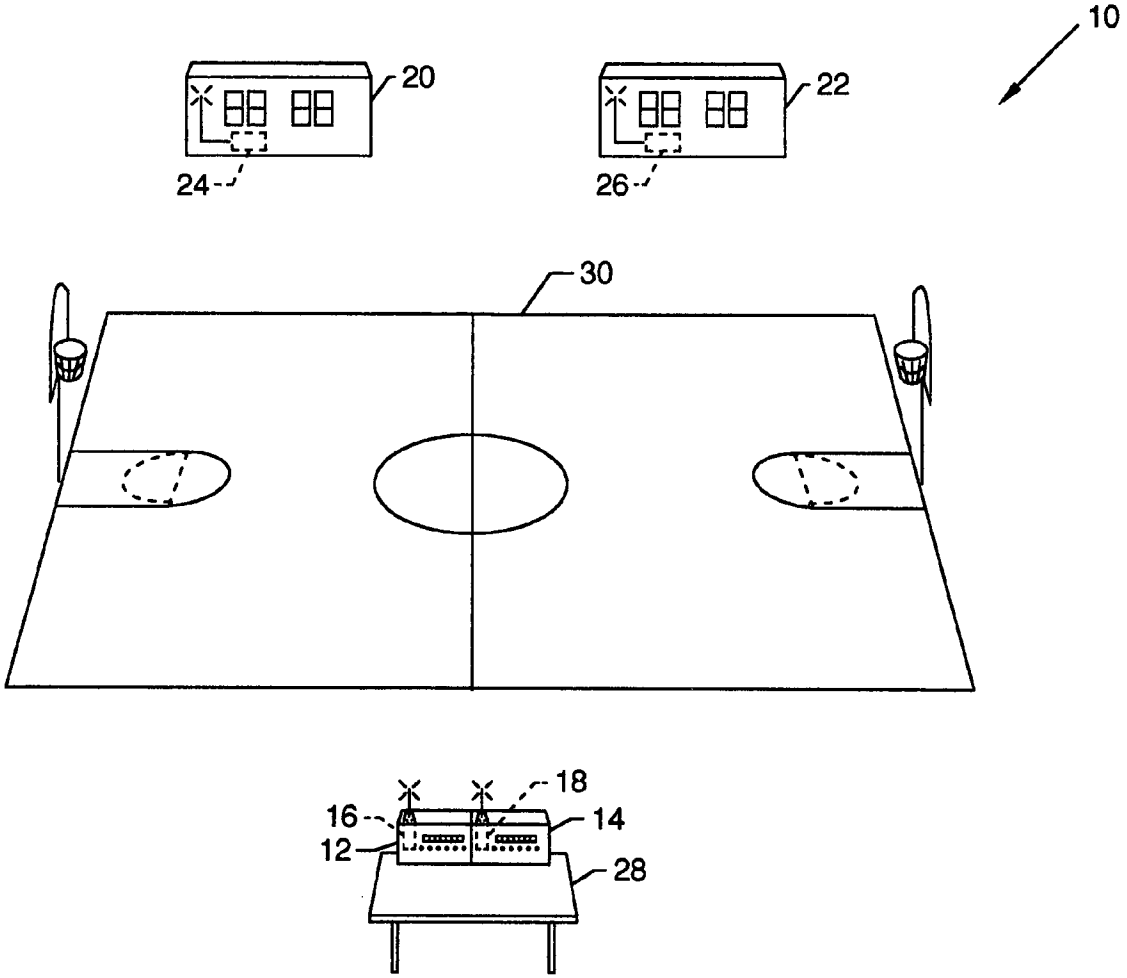
FIG. 1 illustrates a plan view of the wireless scoreboard display system; and, FIG. 2 illustrates the wireless scoreboard display system incorporating two controllers and four scoreboard displays being used in association with two basketball courts.

FIG. 1 illustrates a plan view of the wireless scoreboard display system 10, including two controllers 12 and 14 with radio transmitters 16 and 18, and two scoreboard displays 20 and 22 with radio receivers 24 and 26. Controllers 12 and 14 are shown resting on a referee's table 28 at mid-court of a basketball court 30. The scoreboard displays 20 and 22 are mounted above the basketball court 30, such as on the walls or the wood part between the first and second levels of the court.

The radio transmitters 16 and 18 and the radio receivers 24 and 26 are 2.4 GHZ spread spectrum radio devices. The radio devices use frequency hopping to eliminate interference from outside sources such as cordless phones and other RF devices on the same frequency.

The radio receivers 24 and 26 are housed in ABS plastic enclosures, which are easily mounted inside the scoreboard displays 20 and 22 with a small dipole antenna mounted to the face of or adjacent to the scoreboard displays 20 and 22. Outdoor scoreboard displays 20 and 22 can include rubber gaskets to keep moisture out of the enclosures. The radio receivers 24 and 26 can include a rotary switch or other selection device allowing the user to select different operating channels, normally set once during installation. The instant invention can be used in multi-field complexes, such as in baseball, enabling each system to operate independently without interfering with one another. Currently, there are 16 channels available to select from with the ability to expand to 77 non-interfering channels.

The radio transmitters 16 and 18 are internal to the controllers 12 and 14 to enable channel selection through contained software and contained interconnects. The user will be prompted on an LCD screen or other display of the controllers 12 and 14 as to which channel would be best suited. This eliminates the use of external switches that can wear out, break or degrade over a period of time and use.

The radio receivers 24 and 26 have auto-switching capabilities which monitor the selected transmitting channel, set by an internal switch on installation, as well as the broadcast channel. Once the radio receiver 24 or 26 finds valid scoreboard data, it will lock onto that channel and remain there until the signal is lost.

The auto-switching feature is incorporated to ease the operation of indoor basketball games where the entire system may be operated using one controller (12 or 14) or by splitting the system and operating with two separate controllers (12 and 14). In normal operation and for purposes of example and illustration, one of the controllers can be set to broadcast channel 0 (zero) through on-board software. All of the scoreboard displays 20 and 22 will automatically find the data coming from this controller since they are more than likely receiving nothing on their selected channel and will search the spectrum until a suitable and proper signal on one of the channels is encountered. When split court operation is required, the different controllers 12 and 14 are set to the channel of the scoreboard displays 20 or 22 which it needs to control. The scoreboard displays 20 and 22 will again automatically find the data coming from the controller 12 or 14 set to the selected channel of the scoreboard displays 20 and 22.

The radio receivers 24 and 26 will always come up set to the channel it was last operating on. If last operated in select mode and switched back to broadcast mode, a 3–5 second delay may be experienced and a 7–10 second delay when multi-broadcast is enabled, compared to a 30 second delay found with competitor systems, where the receiver synchronizes with the controller unit. There is no delay if the system is operated in the same mode as when the system was shut down.

The instant invention operates along the spread spectrum radio system and operates at 2.4 GHZ, such as a 2.4 GSS Micro Hopper by World Wireless Communications, Inc.

The spread spectrum radio system also has multiple broadcast channels to allow for adjacent facilities to also operate simultaneously in either a split court or full court mode. This is accomplished by assigning one broadcast channel to receivers set to channel 1–15 and another broadcast channel to receivers set to channel 17–32.

The spread spectrum radio system also has a master broadcast that all radio receivers 24 and 26 monitor during the auto switching mode that will again allow every scoreboard display, such as scoreboard displays 20 and 22, in the facility to run from one single controller 12 or 14. Thus, the auto switching sequence, when multi-broadcast mode is enabled, would be to check the selected channel, its primary broadcast channel, and finally the master broadcast channel.

Figure 2:
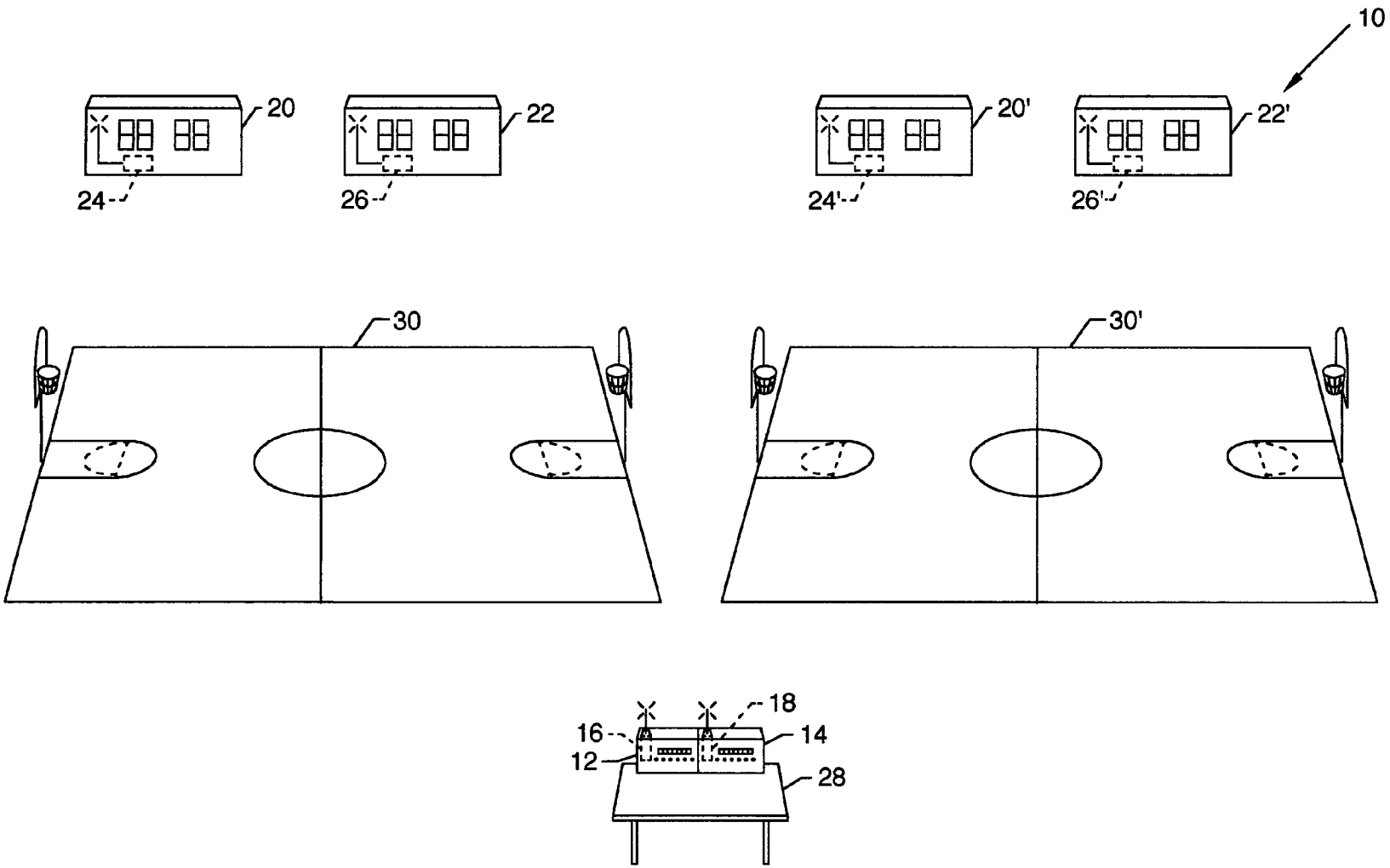

FIG. 2 illustrates the wireless scoreboard display system 10 incorporating two controllers 12 and 14 with radio transmitters 16 and 18 and four scoreboard displays 20, 22, 20' and 22' with radio receivers 24, 26, 24' and 26' being used in association with two basketball courts 30 and 30'.

Various modifications can be made to the present invention without departing from the apparent scope hereof.

It is claimed:

1. A wireless scoreboard display system comprising:

a. at least two scoreboard displays, each of said scoreboard displays including a radio receiver; and, b. at least one controller including a radio transmitter transmitting data to be displayed; and, c. a channel selector means to select one or more of said scoreboard displays to receive and display the transmitted data.

2. The wireless scoreboard display system as defined in claim 1, wherein each radio transmitter is a spread spectrum radio transmitter and each radio receiver is a spread spectrum radio receiver.

3. The wireless scoreboard display system of claim 2, wherein the channel selector means includes a combination of hardware and software used to select a primary channel of the radio receiver included in each of the scoreboard displays.

4. The wireless scoreboard display system of claim 3, wherein the hardware includes a rotary switch.

5. The wireless scoreboard display system of claim 2, wherein the channel selector means includes software used to select the primary transmitting channel of the radio transmitter of the at least one controller.

6. The wireless scoreboard display system of claim 5, wherein each controller further includes means for prompting as to which channel would be best to select.

7. The wireless scoreboard display system of claim 2, wherein the channel selector means includes a combination of hardware and software used to select a primary channel of the radio receiver included in each of the scoreboard displays and also includes software used to select the primary channel of the radio transmitter of the at least one controller.

8. The wireless scoreboard display system of claim 2, wherein the channel selector means further includes a master broadcast channel for transmission of data from the at least one controller and receiving of data by all of the at least two scoreboard displays, wherein the master broadcast channel is distinct from the selected primary channel of each scoreboard display of the at least two scoreboard displays.

9. The wireless scoreboard display system of claim 2, wherein the primary channels are 2.4 GHz channels, the at least two scoreboard displays are two scoreboard displays and the selected primary channel of one receiver is selected from channels 1–15 and the selected primary channel of the other receiver is selected from channels 17–32.

10. A wireless scoreboard display system comprising:

a. at least two scoreboard displays, each of said scoreboard displays including a radio receiver; and, b. at least two controllers each including a radio transmitter transmitting data to be displayed; and, c. a channel selector means to select one or more of said scoreboard displays to receive and display the transmitted data.

11. The wireless scoreboard display system as defined in claim 10, wherein each radio transmitter is a spread spectrum radio transmitter and each radio receiver is a spread spectrum radio receiver.

12. The wireless scoreboard display system of claim 11, wherein the channel selector means includes a combination of hardware and software used to select a primary channel of the radio receiver included in each of the scoreboard displays.

13. The wireless scoreboard display system of claim 12, wherein the hardware includes a rotary switch.

14. The wireless scoreboard display system of claim 11, wherein the channel selector means includes software used to select the primary transmitting channel of the radio transmitter of each of the at least two controllers.

15. The wireless scoreboard display system of claim 14, wherein each controller further includes means for prompting as to which channel would be best to select.

16. The wireless scoreboard display system of claim 11, wherein the channel selector means includes a combination of hardware and software used to select the a primary channel of the radio receiver included in each of the scoreboard displays and also includes software used to select the primary channel of the radio transmitter of the at least two controllers.

17. The wireless scoreboard display system of claim 11, wherein the channel selector means further includes a master broadcast channel for transmission of data from the at least two controllers and receiving of data by all of the at least two scoreboard displays, wherein the master broadcast channel is distinct from the selected primary channel of each scoreboard display of the at least two scoreboard displays.

18. The wireless scoreboard display system of claim 11, wherein there are two controllers, four scoreboard displays, and two adjacent basketball courts, two of the four scoreboard displays displaying data relating to one basketball court and the other two scoreboard displays displaying data relating to the other basketball court.

19. The wireless scoreboard display system of claim 11, wherein the system is associated with a multi-field baseball complex, each baseball field of the multi-field baseball complex having a scoreboard display, and wherein each scoreboard display has a selected primary channel which is non-interfering with other selected primary channels of the multi-field baseball complex.

* * * * *